US008740000B2

(12) United States Patent
Moriyama et al.

(10) Patent No.: US 8,740,000 B2
(45) Date of Patent: Jun. 3, 2014

(54) OPENING DEVICE FOR LIQUID FOOD CONTAINER AND LIQUID FOOD CONTAINER

(75) Inventors: Yasuyuki Moriyama, Ooiso-machi (JP); Koshaku Ito, Oiso-machi (JP)

(73) Assignee: Tetra Laval Holdings & Finance, S.A., Pully (CH)

( * ) Notice: Subject to any disclaimer, the term of this patent is extended or adjusted under 35 U.S.C. 154(b) by 0 days.

(21) Appl. No.: 13/813,039

(22) PCT Filed: Jul. 29, 2011

(86) PCT No.: PCT/JP2011/067410

§ 371 (c)(1),
(2), (4) Date: Mar. 26, 2013

(87) PCT Pub. No.: WO2012/017934

PCT Pub. Date: Feb. 9, 2012

(65) Prior Publication Data

US 2013/0200074 A1 Aug. 8, 2013

(30) Foreign Application Priority Data

Jul. 31, 2010 (JP) ..... 2010-173224

(51) Int. Cl.
*B65D 17/36* (2006.01)
*B65D 51/18* (2006.01)
*B65D 17/00* (2006.01)

(52) U.S. Cl.
CPC ..... *B65D 17/163* (2013.01); *B65D 51/18* (2013.01); *B65D 2543/00296* (2013.01)
USPC ..... 220/270; 220/819; 220/254.6; 220/254.2; 220/259.1; 215/254; 215/235

(58) Field of Classification Search
CPC .. B65D 17/163; B65D 17/165; B65D 17/161; B65D 51/18
USPC ..... 220/270, 266, 265, 254.6, 254.3, 254.2, 220/254.1, 259.1, 256.1, 212, 819, 253; 215/253, 250, 228, 235, 254; 53/492; 222/556
See application file for complete search history.

(56) References Cited

U.S. PATENT DOCUMENTS 2,068,444 A * 1/1937 Breckenridge ..... 215/254
3,543,998 A * 12/1970 Dunlap ..... 229/241

(Continued)

FOREIGN PATENT DOCUMENTS

JP 2000-72172 A 3/2000
JP 2000-226029 A 8/2000

(Continued)

*Primary Examiner* — Robert J Hicks
(74) *Attorney, Agent, or Firm* — Finnegan, Henderson, Farabow, Garrett & Dunner, LLP

(57) ABSTRACT

An opening device of a liquid food container includes a bottom, a main body, and a top part joined to an upper end of the main body and formed with thermoplastic resin. The top part has a lid integrally moulded with thermoplastic resin. The lid divides the top part and includes weakening lines, a first lid part, a second lid part, and a gripper. A first hinge is formed between the first lid part and the second lid part, the weakening lines are cut when the gripper is pulled up, and the-first lid part rotates on the-first hinge such that the weakening lines open narrowly. A second hinge is formed in an edge of the second lid part, the weakening lines are cut by further pulling the gripper, and the second lid part rotates on the second hinge such that the weakening lines open more widely.

12 Claims, 16 Drawing Sheets

(56) References Cited

U.S. PATENT DOCUMENTS

| | | | | |
|---|---|---|---|---|
| 3,974,931 | A * | 8/1976 | Moller | 215/254 |
| 2002/0125203 | A1* | 9/2002 | Bried et al. | 215/235 |
| 2011/0163097 | A1* | 7/2011 | Chasid et al. | 220/270 |

FOREIGN PATENT DOCUMENTS

| | | | |
|---|---|---|---|
| JP | 2002-362548 | A | 12/2002 |
| JP | 2008-155948 | A | 7/2008 |

* cited by examiner

OPENING DEVICE FOR LIQUID FOOD CONTAINER AND LIQUID FOOD CONTAINER

CROSS REFERENCE TO RELATED APPLICATIONS

This application is a national stage filing under 35 U.S.C. §371 of International Application No. PCT/JP2011/067410, filed on Jul. 29, 2011, which claims priority to Japanese Application No. 2010173224, filed on Jul. 31, 2010, all of which are incorporated herein by reference.

FIELD OF THE INVENTION

This invention relates to an opening device of a liquid food container which fills up with and packages the liquid food, and the liquid food container.

BACKGROUND

Conventionally, there is the opening device formed in the lid of the thermoplastic resin injection molded to the top part of the paper container filled up with the liquid food, such as the milk and soft drinks. In the opening device, as for the packaging material of the liquid food container, paper substrate is covered by an outer layer and an inner layer of thermoplastic resin, a straw hole is covered with thermoplastic resin and a straw hole sealing part is formed. The straw hole sealing part is formed by injection molding. In the straw hole sealing part, when piercing with the straw, the straw does not slip to easily penetrate it, and the straw hole sealing part is necessarily soft not to bend the straw tip part. Therefore, a thin-walled part is formed in the straw hole sealing part by the extent that sealing performance is not damaged.

Another opening device has a lid of thermoplastic resin injection molded to a top part of the paper container filled up with the liquid food, and a thin-walled part for straw holes formed in the lid.

On the thin-walled part, the sealing of the straw hole can be penetrated with the straw. However, there is a risk that the sealing of the thin-walled part may break by the vibration etc. in the conveyance/ distribution process of the liquid food container. It is very difficult to control the balance of sealing and unsealing by means of the thin-walled part of the straw hole.

SUMMARY OF THE INVENTION

The object of the present invention is to provide an opening device and a liquid food container which can open a straw hole easily, which can be drunk with a straw and be directly drunk from the mouth and, can also be filled with a cup and the like, without leaking simply by external force, such as vibration at the time of conveyance, in a liquid food container in which a thermoplastic resin top part is formed at the upper end edge of a main body of a packaging material laminated with the thermoplastic resin on a paper substrate.

An opening device of a liquid food container of this invention or the liquid food container is the opening device of the liquid food container which consists of a bottom and a main body formed with a packaging material which is laminated on both sides of a paper substrate with thermoplastic resin, and a top part which is joined to the upper end of the main body and formed with the thermoplastic resin, or the liquid food container, is characterized by that;

the top part has a lid integrally moulded with the thermoplastic resin and covering a spout, the lid divides the top part and have weakening lines sealing with easily cutting, the lid comprises a 1st lid part on the front-face side of the container, a 2nd lid part on the rear-face side of the container and a gripper projected from the 1st lid part, a 1st hinge is formed between the 1st lid part and the 2nd lid part, the weakening lines are cut at pulling up the gripper, the 1st lid part rounds on the 1st hinge, the weakening lines of the 1st lid part are cut to open narrowly, a 2nd hinge is formed in the edge of the 2nd lid part by the rear-face side of the container, the weakening lines are cut by further pulling up the gripper, the 2nd lid part rounds on the 2nd hinge, and the weakening lines between the 2nd lid part and the periphery of the top part are cut to open more widely.

In the preferable embodiment of this invention, the 1st lid part opened narrowly has a detent stopper, and the dimensions of the portion of the opening opened narrowly correspond to the dimensions of a hole for a straw substantially.

In the preferable embodiment of this invention, the top part comprises a shoulder part on the upper end side of the main body and a neck part projected from the shoulder part.

In the preferable embodiment of this invention, on both sides of the 2nd hinge, the 2nd lid part and the shoulder part have hooks which stop return of the 2nd lid part widely opened on the rear-face side edge part of the 2nd lid part and on the shoulder part of the top part, respectively.

In the preferable embodiment of this invention, the gripper has a plate shape projected in a container front from the 1st lid part In the preferable embodiment of this invention, the gripper has a plate shape which is joined to the 1st lid part top face, and projected in a container front.

The 2nd opening device of the liquid food container of this invention or the 2nd liquid food container has the opening device of the liquid food container which consists of a bottom and a main body formed with a packaging material which is laminated on both sides of a paper substrate with thermoplastic resin, and a top part which is joined to the upper end of the main body and formed with the thermoplastic resin, is characterized by that;

the top part has a lid integrally moulded with the thermoplastic resin and covering a spout, the lid divides the top part and have weakening lines sealing with easily cutting, the lid comprises a 1st lid part in the center of the top part, a 2nd lid part surrounding the 1st lid part, and a gripper projected from the 1st lid part, a 1st hinge is formed between the 1st lid part and the 2nd lid part, by pulling up the gripper; the 1st lid part rounds on the 1st hinge, the weakening line between the 1st lid part and the 2nd lid part is cut to open narrowly, and a 2nd hinge is formed in the edge of the 2nd lid part by the side of the container rear face, by further pulling up the gripper, the 2nd lid part rounds on the 2nd hinge, the weakening lines between the 2nd lid part and the periphery of the top part are cut to open more widely.

In the preferable embodiment of the 2nd invention, the dimensions of the portion of the opening of the 1st lid part narrowly opened correspond substantially to the dimensions of the hole for the straw, or the dimensions larger than the dimensions of the hole for the straw.

In the preferable embodiment of the 2nd invention, the shoulder part of the top part has a hook which stops return of the 2nd lid part widely opened.

In the preferable embodiment of the 2nd invention, the gripper has a shape projected above the container from the 1st lid part.

According to the above present invention, the following functions are shown and the advantageous effect is obtained. The liquid food container of the opening device in this invention consists of the main body and the bottom formed in the packaging material which is laminated on both sides of paper substrate with the thermoplastic resin, and the top part joined to the upper end of the main body and formed with thermoplastic resin, for example, by injection molding. Since the top part is formed with the thermoplastic resin layer, the shape and the thinness can be controlled or designed easily.

In the feature of the present invention, the top part has the lid integrally moulded with the thermoplastic resin and covering the spout. Since the lid is integrally moulded to the top part with the thermoplastic resin, the top part and the lid can be formed efficiently. The lid can cover the spout and the spout can be protected certainly at conveyance of the distribution process.

In the feature of the present invention, the lid divides the top part and the lid has the weakening lines with sealing and easy cutting. At the time of unsealing of the lid, the weakening lines are cut along the lines. Since the weakening lines are provided in the position which divides the 1st lid part and the 2nd lid part also in the position which divides the lid and the top part, the lid can be cut easily.

In the feature of the present invention, the lid comprises the 1st lid part on the front-face side of the container, the 2nd lid part on the rear-face side of the container and the gripper projected from the 1st lid part. The 1st hinge is formed between the 1$^{st}$ lid part and the 2nd lid part, by pulling up the gripper, the 1st lid part rotates centering on the 1st hinge, and a narrow opening is opened. In this invention, the spout is first opened narrowly in the 1st lid part. The opening is opened in the area equivalent to the 1st lid part. The opening of the 1st lid part opened narrowly can be equivalent to the opening for the straws, this portion can be protected by the 1st lid part having thickness, the thin-walled part for the straw hole can be omitted, and the trouble by means of the fragile thin-walled part can be dissolved. Preferably, the dimensions of the portion of this opening correspond to the dimensions of the hole for the straws nearly. The straw can be inserted in the portion of the opening opened narrowly, and the liquid food inside the container can be taken with the straw held there.

In the feature of the present invention, the 2nd hinge is formed in the edge of the 2nd lid part by the side of the container rear face, by further pulling up the gripper, the 2nd lid part rotates centering on the 2nd hinge, and the opening is opened more widely. In this invention, in the 2nd step, the opening of the spout is further opened more widely by unsealing of the 2nd lid part. The opening is widely opened in the area equivalent to the total of the 1st lid part and the 2nd lid part. The portion of the wide opening corresponds to the spout to which the consumers can directly take the liquid food from the container's mouth. By touching their mouth close to the portion of the opening opened widely, the liquid food inside the container can be taken directly.

In the preferable embodiment of this invention, the 1st lid part opened narrowly has the detent stopper, and the dimensions of the portion of the opening opened narrowly correspond substantially to the dimensions of the hole for the straws. The stopper stops return of the 1st lid part, with certainly relaxed feeling, the straw can be inserted to the hole for the straw.

In the preferable embodiment of this invention, the top part comprises the shoulder part on the upper end side of the main body and the neck part projected from the shoulder part. By consisting of the shoulder part and the neck part, the container can be used like the other container such as the bottle for liquid food with favorite manner.

In the preferable embodiment of this invention, on both sides of the 2nd hinge, the 2nd lid part and the shoulder part have hooks which stop return of the 2nd lid part widely opened on the rear-face side edge part of the 2nd lid part and on the shoulder part of the top part, respectively. The hooks prevent return of the 2nd lid part, and from the spout opened widely, and the consumers feel easy certainly and can take the food directly.

In the preferable embodiment of this invention, the gripper has a plate shape projected in a container front from the 1st lid part, or the gripper has a plate shape which joined to the 1st lid part top face, and projected in a container front. The projected tabular grippers can be grasped easily, and strong power may not be required, for example, elderly people and the small child can also open easily.

In another feature of the present invention, the lid consists of the 1st lid part in the center of the top part, the 2nd lid part surrounding the 1st lid part, and the gripper projected from the 1st lid part. The 1st hinge is formed between the 1st lid part and the 2nd lid part, by pulling up the gripper, the 1st lid part rotates centering on the 1st hinge, and the opening is narrowly opened along the weakening line. In this invention, the spout is first opened narrowly in the 1st lid part. The opening is opened in the area equivalent to the 1st lid part. Preferably, the dimensions of the portion of this opening correspond to the dimensions of the hole for the straw substantially. In the dimensions, the outer wall of the straw tube is contacted at least at two points of the edge of the opening, preferably the three points or more. Drop or detachment of the straw is prevented by the contacts. The straw can be inserted in the portion of the opening opened narrowly, and the liquid food inside the container can be taken with the straw. The portion equivalent to the opening for the straws can be protected by the thick 1st lid part, the thin-walled part of the straw hole can be omitted, and the trouble by means of the fragile thin-walled part can be dissolved.

In another feature of the present invention, the 2nd hinge is formed in the edge of the 2nd lid part by the side of the container rear face, by further pulling up the gripper, the 2nd lid part rounds on the 2nd hinge, and the opening is opened more widely along the weakening line. In this invention, in the 2nd step, the opening of the spout is opened more widely by unsealing of the 2nd lid part. The opening is widely opened with the total area equivalent to the 1st lid part and the 2nd lid part. The portion of this wide opening corresponds to the spout from which the consumers take the liquid food in the container directly through their mouth. By touching their mouth close to the portion of the opening opened widely, the liquid food inside the container can be taken directly.

In the preferable embodiment of this invention, the 1st lid part opened narrowly as mentioned above prevents the drop of the straw, and the dimensions of the portion of the opening opened narrowly correspond to the dimensions of the hole for the straws. The 1st lid part itself stops the straw drop, and with relieved feeling certainly the straw can be inserted into the hole for the straws.

In the preferable embodiment of the 2nd invention, the shoulder part of the top part has the hook which stops return of the 2nd lid part widely opened. The hook prevents return of the 2nd lid part, with relieved feeling certainly, and the consumers can directly take the food from the spout opened widely.

In the preferable embodiment of this invention, the gripper has the shape projected from the 1st lid part above the container. The cylindrical or pillar-shaped, projected gripper can be grasped easily, and strong power may not be required, for example, elderly people and the small child can also open easily.

DETAILED DESCRIPTION

Figure 1:
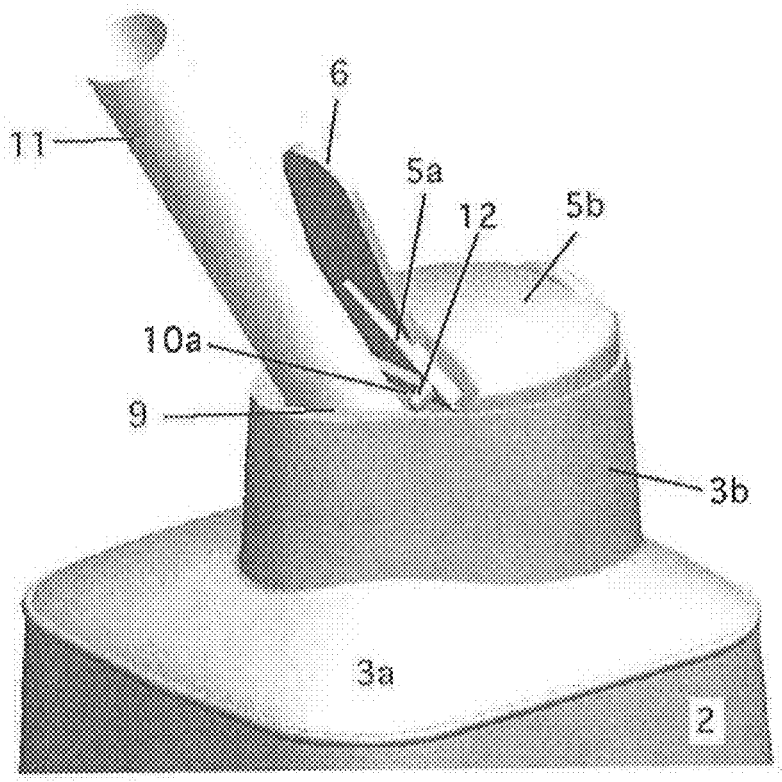
FIG. 1 is an outline view in part showing an appearance that the straw is inserted in the portion of the opening opened narrowly by narrow opening of the 1st lid part of the spout, in the 1st example of the container provided with the opening device of this invention.

Preferred embodiments of the present invention will hereinafter be described in detail with reference to the attached drawings. The outline of the packaging container and the opening device according to this embodiment is explained with the 1st example shown in the outline view of FIG. 3, FIG. 4, FIG. 5, and FIG. 6. This packaging container 1 consists of the main body 2 of the paper container, and the container top part 3 of the thermoplastic resin which is joined to the upper end of the main body 2, and is formed by injection moulding, and the container top part 3 consists of the shoulder part 3*a* and the neck part 3*b*. The lid 5 covering the spout is integrally moulded to the upper end of the neck part 3*b*. Since the top part 3 comprises the shoulder part 3*a* on the upper end side of the main body 2 and the neck part 3*b* projected from the shoulder part 3*a*, the container is used like the other container such as the bottle for liquid food with favorite manner.

The lid 5 divides the top part 3 and the neck part 3*b*, and the lid has the weakening lines 9 with sealing and easy cutting. At the time of unsealing, the weakening lines 9 are cut along the lines. The weakening lines are provided in the boundary position of the lid and the top part, and are cut between the lid 5 and the top part 3 except for the 2nd hinge.

The lid 5 comprises the 1st lid part 5*a* on the front-face side of the container 1, the 2nd lid part 5*b* on the rear-face side of the container 1 and the gripper 6 projected from the 1st lid part 5*a*. The 1st hinge 7 is formed between the 1st lid part 5*a* and the 2nd lid part 5*b*, by pulling up the gripper 6, the weakening lines 9 are cut along the lines, the 1st lid part 5*a* rotates centering on the 1st hinge 7 and the opening is narrowly opened. In this embodiment, the gripper 6 has the plate shape projected in container front from the 1st lid part 5*a*, and the gripper 6 joins the 1st lid part top further. The projected plate-shaped gripper is grasped easily, and with no required strong power, for example, elderly people and the small child also can open it easily.

Figure 8:
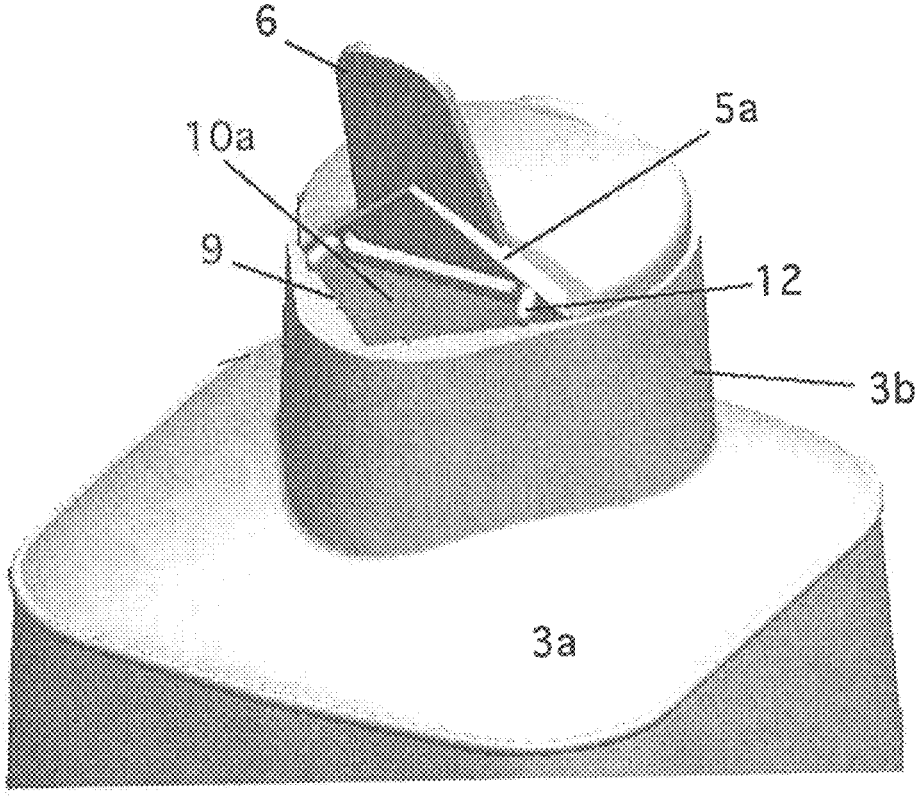
FIG. 8 is a partial side outline view showing the appearance that the spout is opened narrowly and the 1st lid part is opened, in the 1st example of the container provided with the opening device according to this invention.
Figure 9:
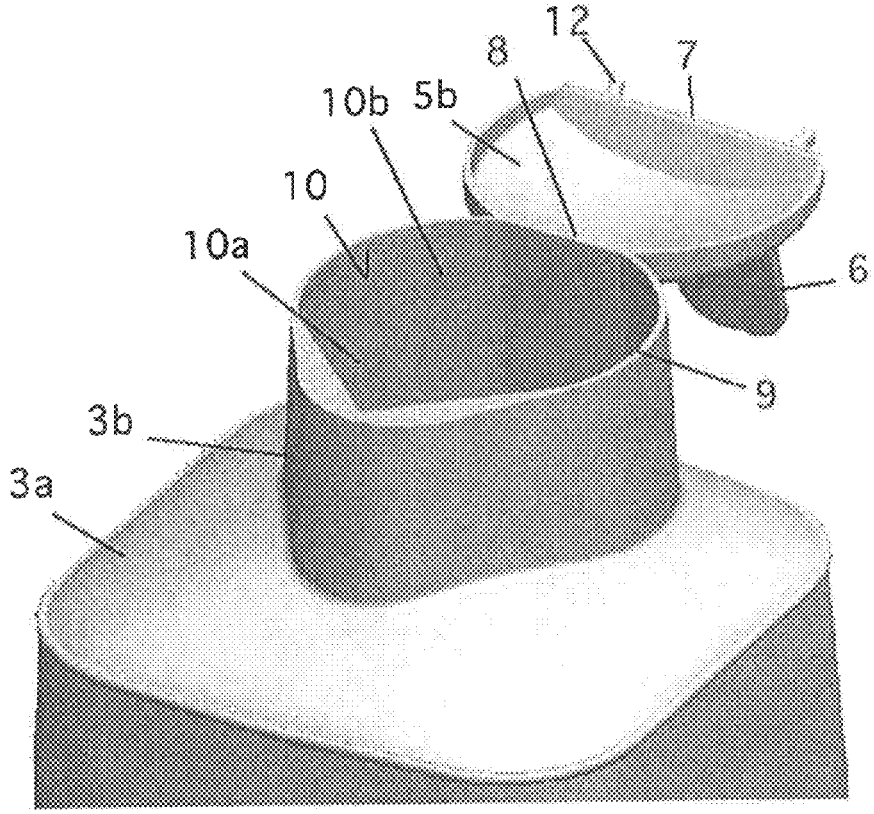
FIG. 9 is a perspective outline view in part showing the appearance that the spout of the 1st lid part is opened narrowly, in the 1st example of the container provided with the opening device according to this invention.

As the 1st step of unsealing according to this embodiment, the 1st example shown in the outline view of FIG. 8, FIG. 9, and FIG. 1 explains the appearance that the 1st lid part is opened and the spout 10 is narrowly opened. The portion 10*a* of this opening corresponds to the hole for the straws. As shown in FIG. 1, the straw 11 can be inserted in the portion 10*a* of the opening opened narrowly, and the liquid food inside the container can be taken with the straw 11. As shown in FIG. 1, the straw 11 can be inserted in the portion 10*a* of the opening opened narrowly, and the liquid food inside the container can be taken with the straw 11. The stopper 12 stops return of the 1st lid part 5*a*, and with relieved feeling, the straw 11 can be inserted in the hole 10*a* for the straws.

Figure 10:
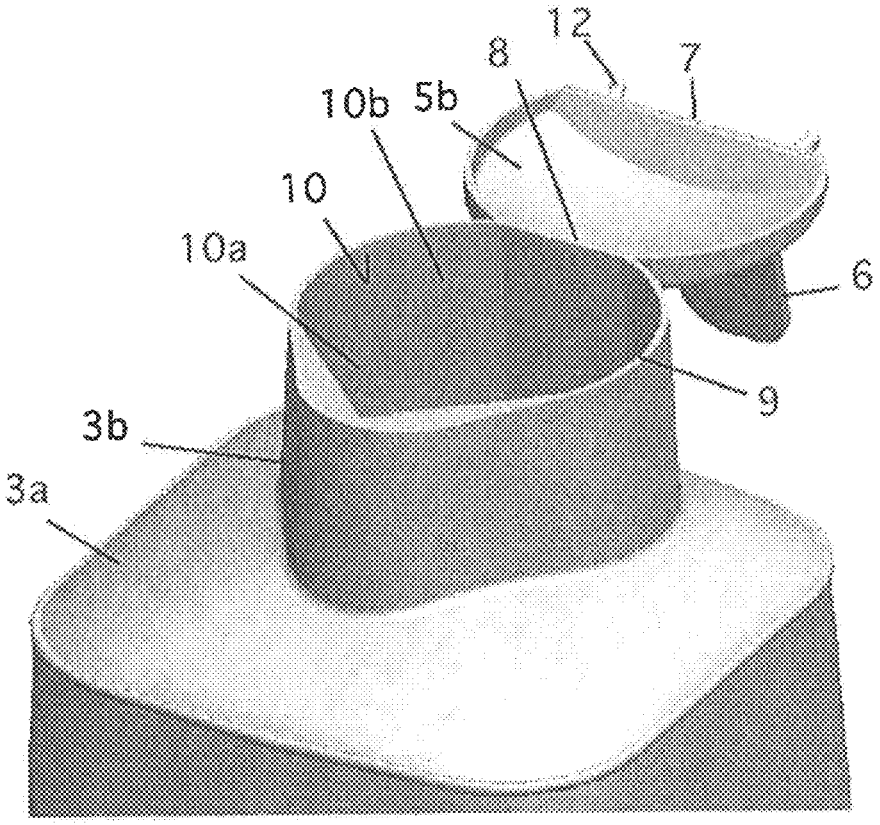
FIG. 10 is a perspective outline view in part showing the appearance that the spout is opened widely in the 2nd lid part, in the 1st example of the container provided with the opening device according to this invention.
Figure 11:
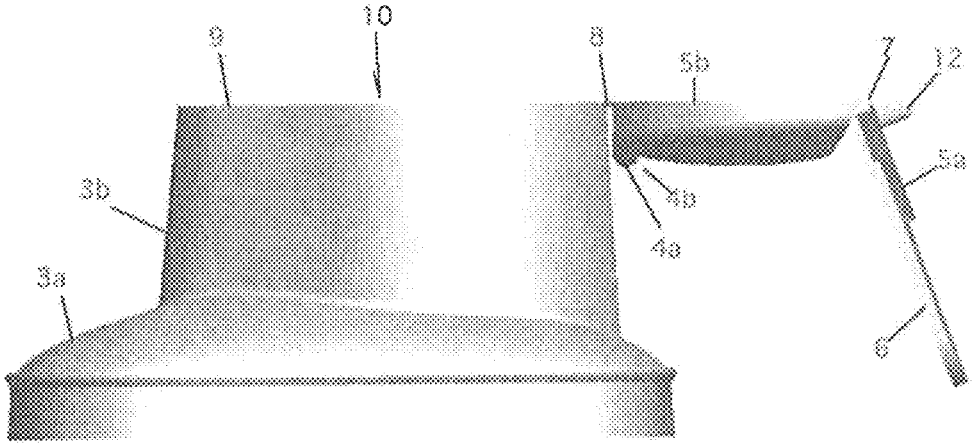
FIG. 11 is a side outline view in part showing the appearance that the spout is opened widely in the 2nd lid part, in the 1st example of the container provided with the opening device according to this invention.
Figure 12:
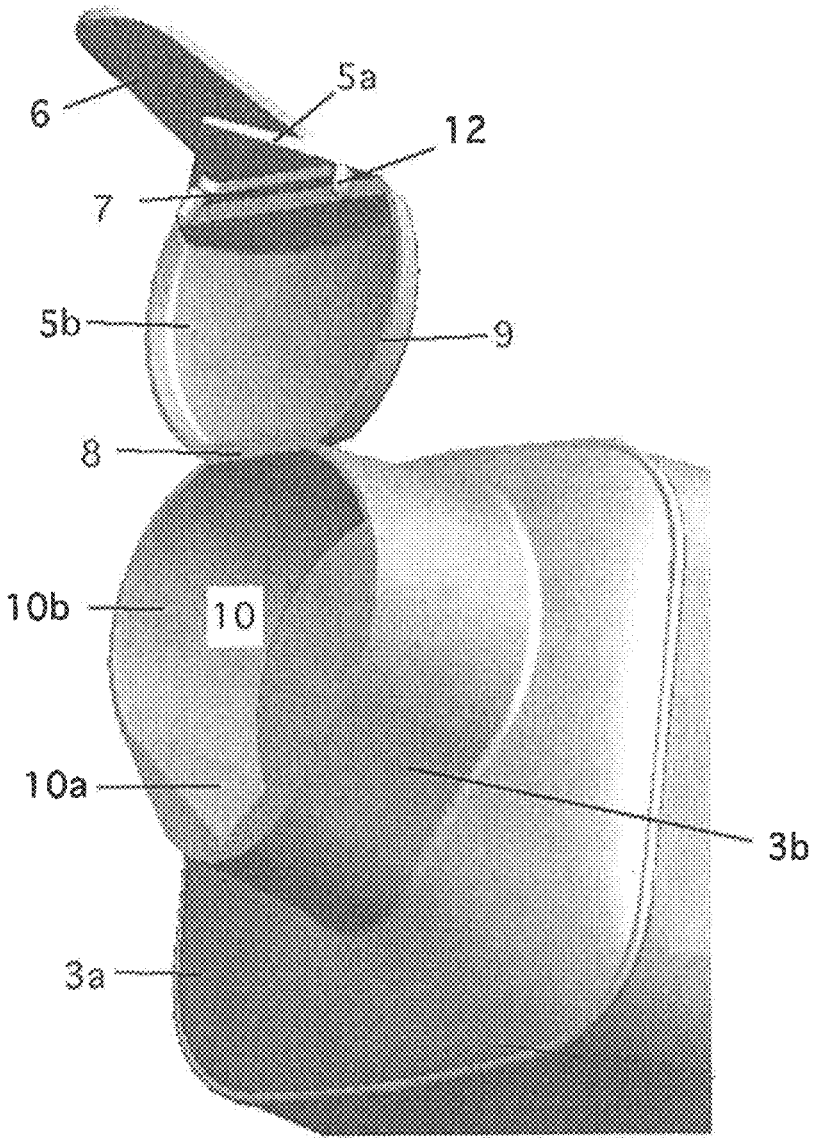
FIG. 12 is a side outline view in part showing the appearance that the spout is opened widely in the 2nd lid part and is leaned for taking or pouring, in the 1st example of the container provided with the opening device according to this invention.

As the 2nd step of unsealing according to this embodiment, the 1$^{st}$ example shown in the outline views of FIG. 10, FIG. 11, and FIG. 12 explains the appearance that the spout 10 is widely opened in the 2nd lid part. In this embodiment, the 2nd hinge 8 is formed in the edge by the side of the container rear face of the 2nd lid part 5*b*, and the gripper 6 is raised more. The gripper 6 and the lid 5 are pulled up to tear the fragile weakening line 9 (thin portion) around the lid 5 outer edge. The weakening line 9 is cut along the line, the 2nd lid part 5*b* rotates centering on the 2nd hinge 8, and the opening is opened more widely. In this embodiment, as the 2nd step, the opening of the spout 10 is opened more widely by unsealing of the 2nd lid part 5*b*. The opening is widely opened in the portion 10*b* equivalent to the 1st lid part and the 2nd lid part. The portion 10*b* of this wide opening corresponds to the spout as a mouthpiece with which the consumers directly take the liquid food by the mouth from the container and as an issue from which the liquid food is poured. The mouth can be brought close to the portion 10*b* of the opening opened widely, and the liquid food inside the container can be taken directly.

In this embodiment, on both sides of the 2nd hinge 8, the 2nd lid part 5*b* and the shoulder part 3*b* have hooks 4*a* and 4*b* which stop return of the 2nd lid part 5*b* widely opened on the rear-face side edge part of the $2^{nd}$ lid part 5*b* and on the shoulder part 3*b* of the top part, respectively. The hooks 4*a* and 4*b* prevent return of the 2nd lid part, and from the spout opened widely, the consumers feel easy certainly and can take directly the food. In order to take or to pour the liquid, it is taken or poured out from the spout which is leaned as shown in FIG. 12, and is widely opened by the 2nd lid part.

The 2nd example shown in the outline views of FIG. 13, FIG. 14, FIG. 15, and FIG. 16 explains the outline of the packaging container and the opening device according to another embodiment, This packaging container 1 consists of the main body 2 of the paper container, and the container top part 3 of the thermoplastic resin which is joined to the upper end of the main body 2, and is formed by injection moulding. The container top part 3 consists of the shoulder part 3*a* and the top face 3*c*. The lid 5 which covers the spout (issue) is integrally moulded to the center section of the top face 3*c*. Since the top part 3 consists of the shoulder part 3*a* on the upper end side of the main body 2 and the flat top face 3*c* from the shoulder part 3*a*, the container can be used like the other container such as a can and a brick-like paper carton for liquid food with favorite manner.

Figure 13:
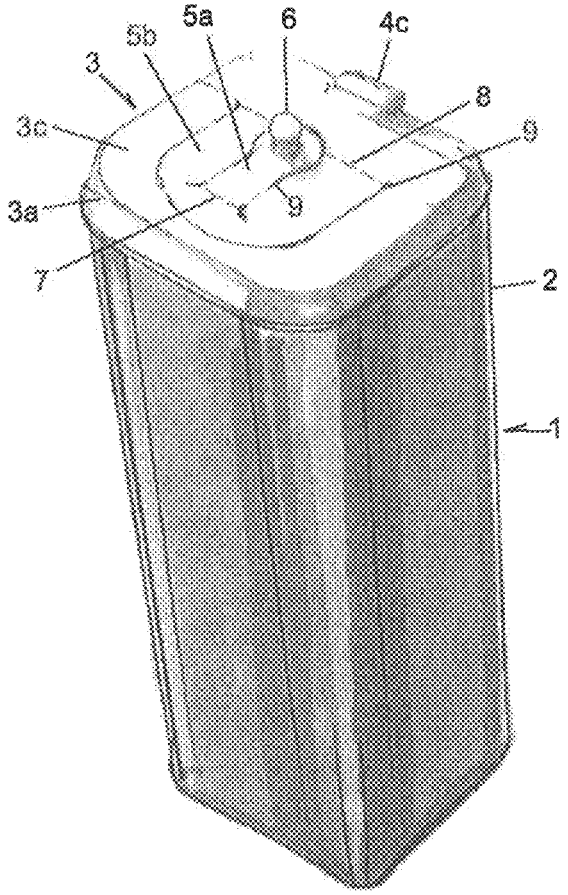
FIG. 13 is a perspective outline view showing the 2nd example of the liquid food container provided with the opening device according to this invention.

As shown in FIG. 13, the lid 5 divides the top face 3*c* of the top part 3 and is divided to the 1st lid part 5*a* and the 2nd lid part 5*b*, as well as has the weakening lines 9 which seal with easy cutting. At the time of unsealing, the weakening lines 9 are cut along the line. The weakening lines are provided in the boundary positions with the lid and the top part and with the 1st lid part 5*a* and the 2nd lid part 5*b*, and in the boundaries, the weakening lines are cut except for the 1st and 2nd hinges.

The lid 5 consists of the 1st lid part 5*a* in the center of top face 3*c* of the top part of the container 1, the 2nd lid part 5*b* surrounding the 1st lid part 5*a*, and the gripper 6 projected from the 1st lid part 5*a*. The 1st hinge 7 is formed between the 1st lid part 5*a* and the 2nd lid part 5*b*, by pulling up the gripper 6 to the front-face side of the container, the weakening lines 9 are cut along the lines, the 1st lid part 5*a* rotates centering on the 1st hinge 7 and the opening is narrowly opened. In this embodiment, the gripper 6 has the knob shape which consists of a pillar projected from the 1st lid part 5*a* above container, and a ball at its tip, and the gripper 6 joins to the 1st lid part top. The projected plate-shaped gripper is grasped easily, and with no required strong power, for example, elderly people and the small child also can open it easily.

Figure 14:
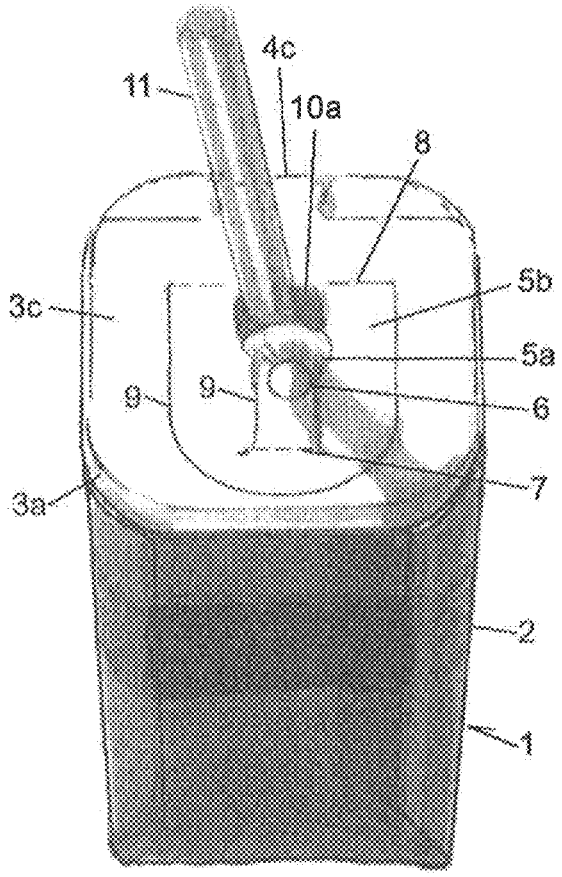
FIG. 14 is a perspective outline view showing the appearance that the spout is opened narrowly and the 1st lid part is opened, in the 2nd example of the container provided with the opening device according to this invention.

As the 1st step of unsealing according to this embodiment, the 2nd example shown in the outline view of FIG. 14 explains the appearance that the 1st lid part is opened and the spout 10*a* is narrowly opened. The dimensions of the portion 10*a* of this opening correspond to the dimensions of the hole for the straw nearly. As shown in FIG. 14, the straw 11 can be inserted in the portion 10*a* of the opening opened narrowly, and the liquid food inside the container can be taken with the straw 11. In this embodiment, since the 1st lid part 5*a* pulled up has a return force centering on the 1st hinge 7, the 1st lid part 5*a* presses down the straw, and has the safety catch function of the straw. The portion 10*a* of the opening opened narrowly is used as a hole for the straw. The 1st lid part 5*a* stops drop of the straw, with relieved feeling, the straw 11 can be inserted and used for the hole 10*a* for the straw.

Figure 15:
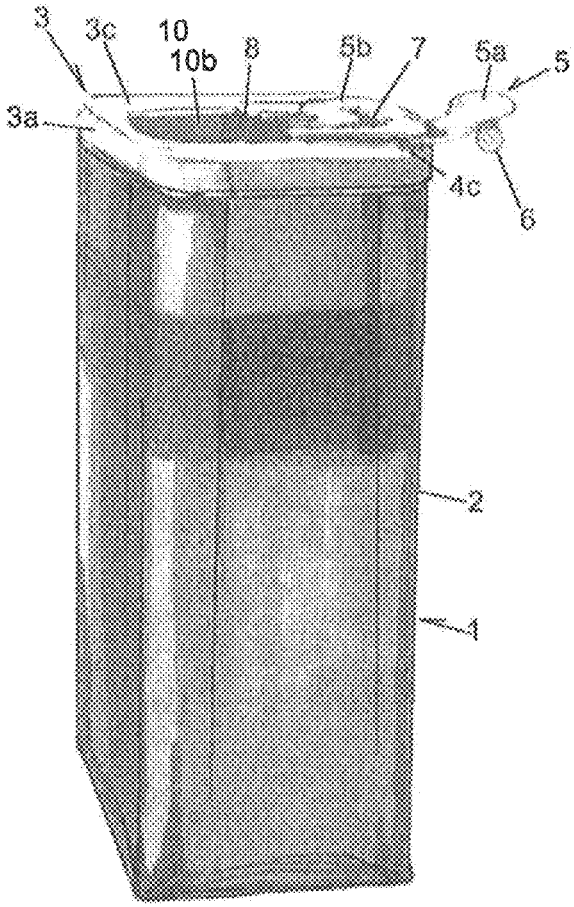
FIG. 15 is a side outline view showing the appearance that the spout is opened widely in the 2nd lid part, in the 2nd example of the container provided with the opening device according to this invention.
Figure 16:
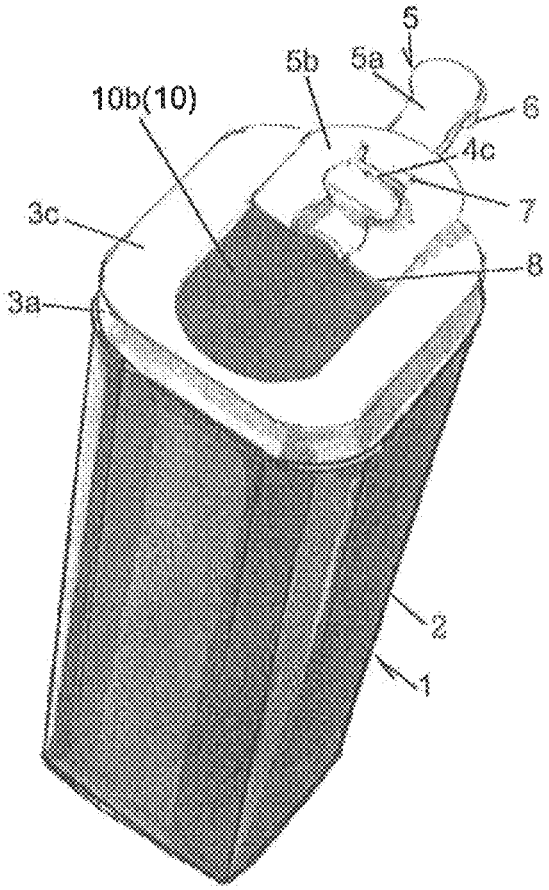
FIG. 16 is a perspective outline view showing the appearance that the spout is opened widely in the 2nd lid part, in the 2nd example of the container provided with the opening device according to this invention.

As the 2nd step of unsealing according to this embodiment, the 2nd example shown in the outline views of FIG. 15 and FIG. 16 explains the appearance that the spout 10 is widely opened in the 2nd lid part. In this embodiment, the 2nd hinge 8 is formed between the 2nd lid part 5*b* and the edge of the spout 10 by the side of the rear face. When the gripper 6 is further pulled up, the weakening line 9 partially surrounding the outer edge of the 2nd lid part 5*b* are torn, and the gripper 6 and the lid 5 are pulled up. The weakening line 9 is cut along the line, the 2nd lid part 5*b* rotates centering on the 2nd hinge 8, and the opening is opened more widely. In this embodiment, as the 2nd step, the opening of the spout 10 is opened more widely by unsealing of the 2nd lid part 5*b*. The opening is widely opened with the dimensions equivalent to the 1st lid part and the 2nd lid part. The portion 10*b* of this wide opening corresponds to the spout as a mouthpiece with which the consumers directly take the liquid food by the mouth from the container and as an issue from which the liquid food is poured. The mouth can be brought close to the portion 10*b* of the opening opened widely, and the liquid food inside the container can be taken directly.

In this embodiment, the shoulder part 3*a* of the top part has the hook 4*c* which stops return of the 2nd lid part widely opened. The hook 4*c* stops return of the 2nd lid part opened widely by engaging with the edge of the hinge 7. The hook 4*c* prevents return of the 2nd lid part, and with relieved feeling, the consumers can directly take the food from the spout opened widely. In order to take or to pour the liquid, by leaning the whole container, it is taken or poured out from the spout widely opened by the 2nd lid part.

In this embodiment, the thermoplastic resin laminated on the paper substrate of the packaging material and the thermoplastic resin which forms the top part include for example, polyolefin system resin, such as polyethylene, polypropylene, and the ethylene system copolymer, low density polyethylene (LOPE), linear low density polyethylene (LLDPE), medium density polyethylene, co-extrusion or blend polymer containing polyethylene, linear low density polyethylene (mLLDPE) having the narrow molecular weight distribution which polymerized using the metallocene catalyst, blend polymer containing at least mLLDPE and the like. Preferably, it consists of the same kind or of a different kind of low density polyethylene.

Figure 2:
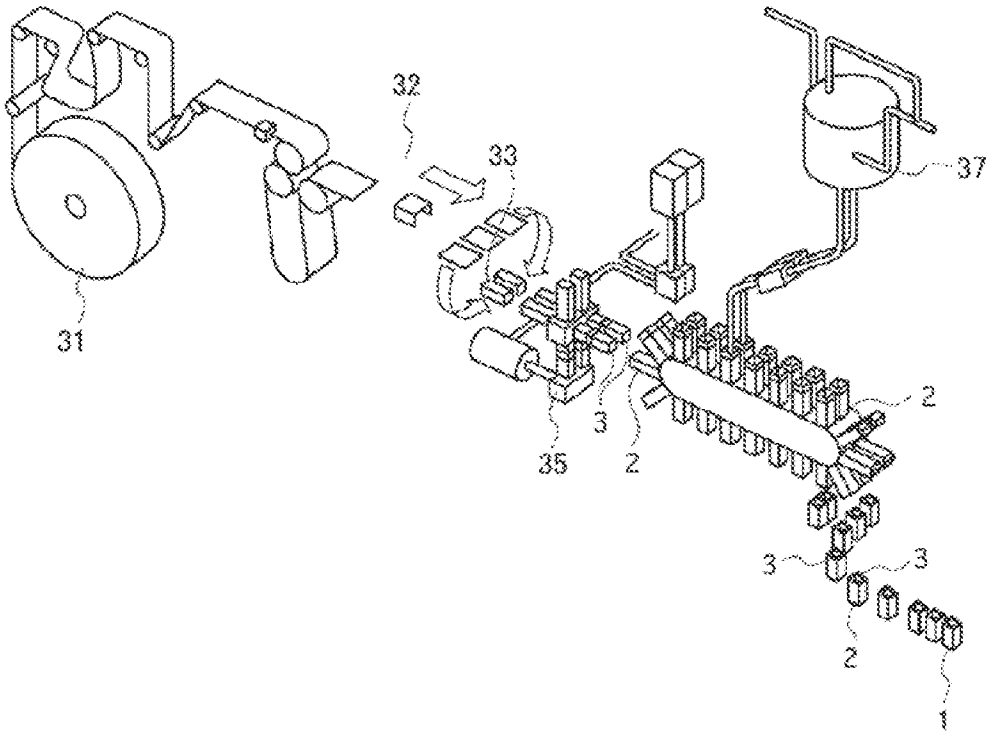
FIG. 2 is an outline view showing the example of the manufacturing process of the liquid food container provided with the opening device.
Figure 3:
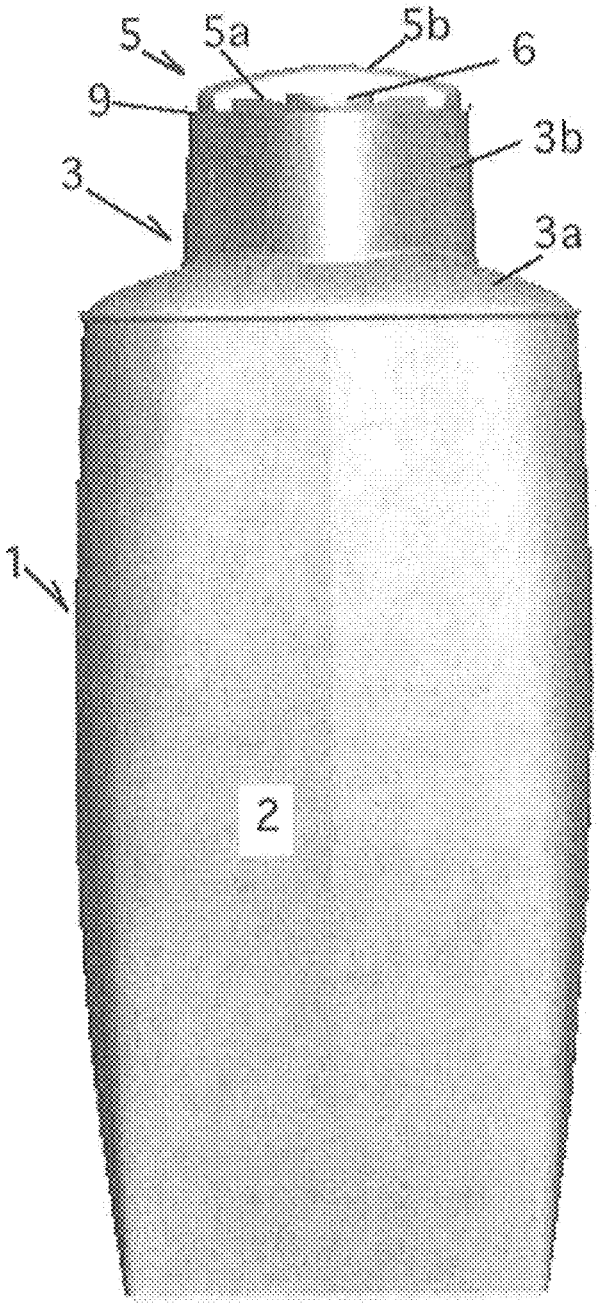
FIG. 3 is a front outline view showing the 1st example of the liquid food container provided with the opening device according to this invention.
Figure 4:
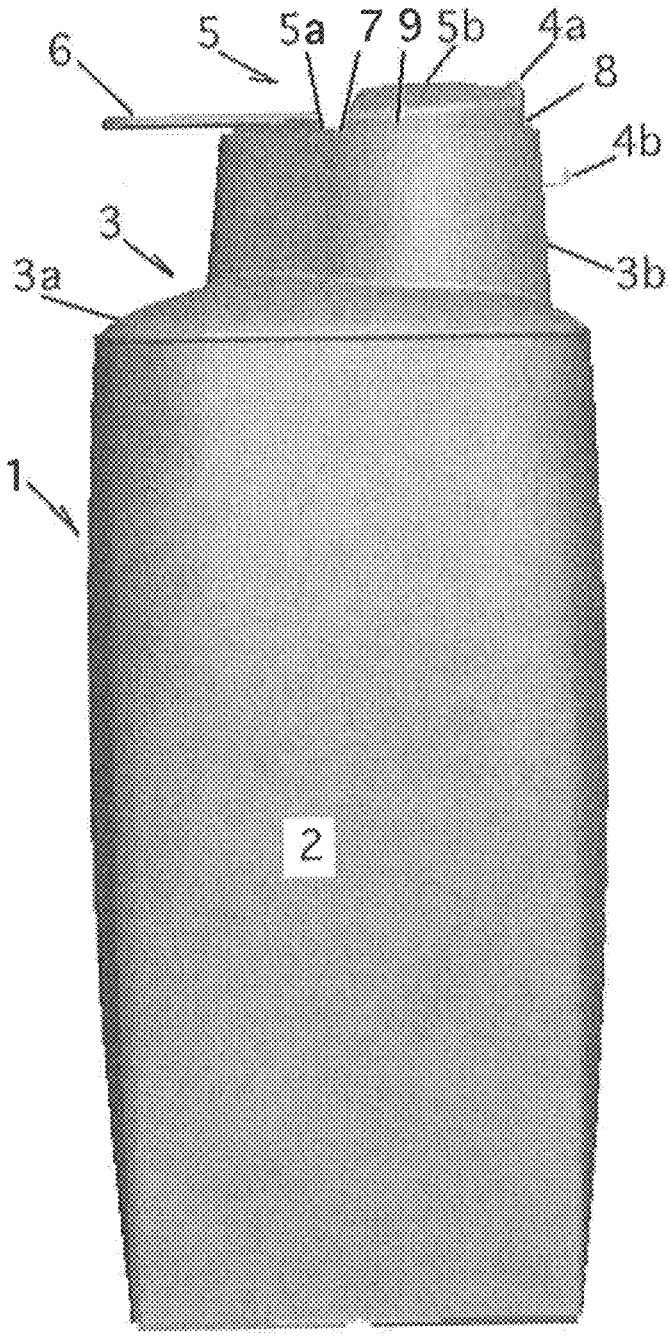
FIG. 4 is a side outline view showing the 1st example of the liquid food container provided with the opening device according to this invention.
Figure 5:
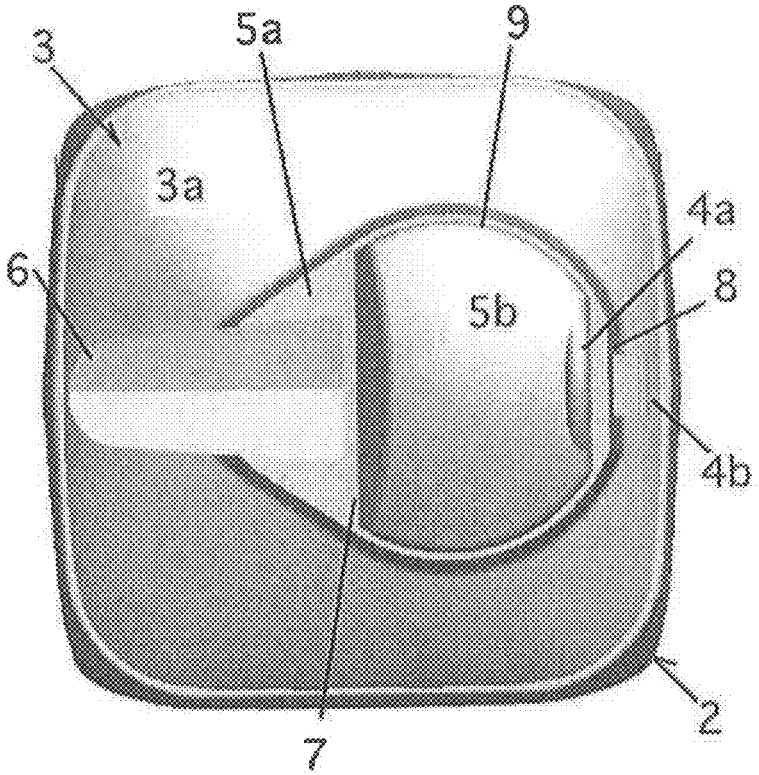
FIG. 5 is a top outline view showing the 1st example of the liquid food container provided with the opening device according to this invention.
Figure 6:
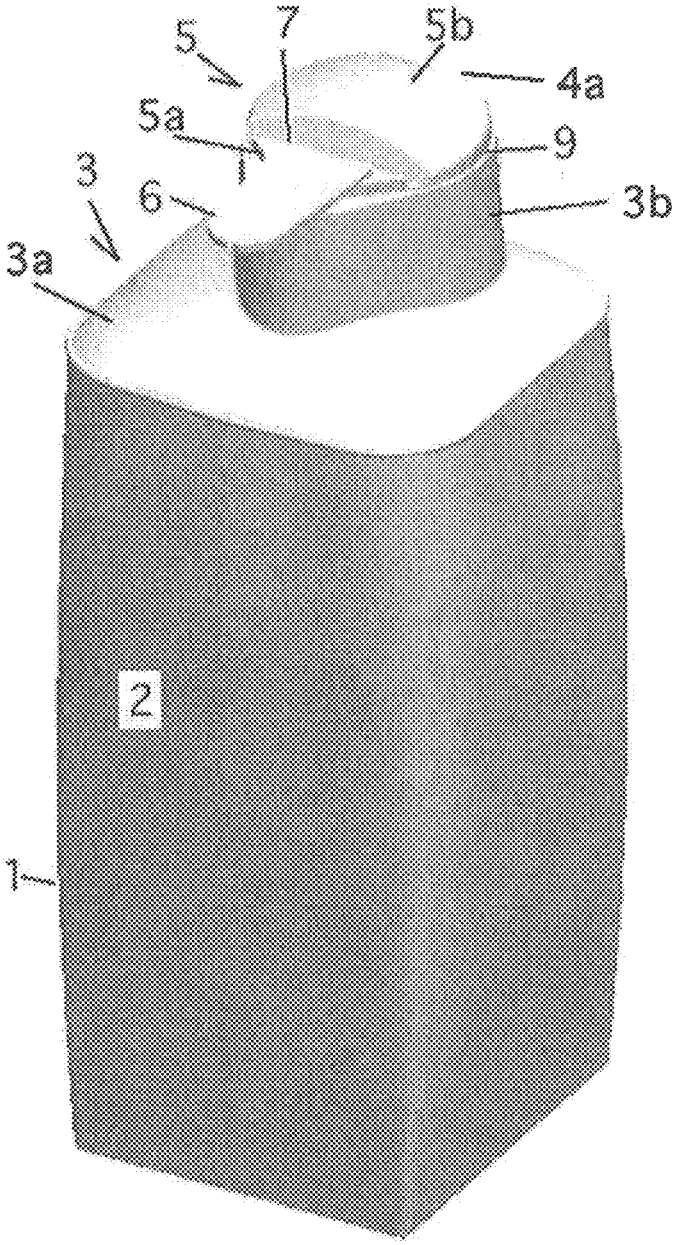
FIG. 6 is a perspective outline view showing the 1st example of the liquid food container provided with the opening device according to this invention.
Figure 7:
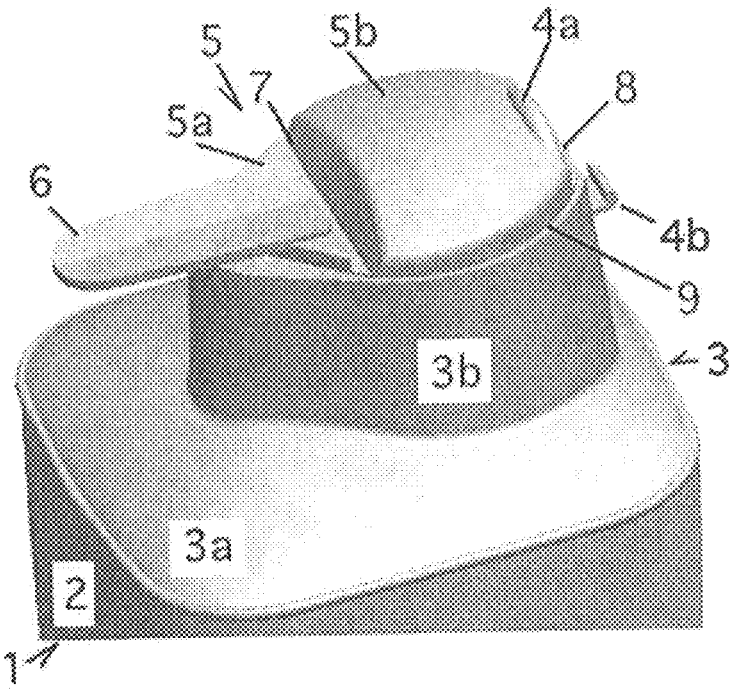
FIG. 7 is a perspective outline view showing the upper part of the 1st example of the liquid food container provided with the opening device according to this invention.

The packaging container 1 of the 1st and 2nd examples is obtained for example by a machine manufacturing composite packaging containers shown in FIG. 2. The web-like laminating paper packaging material 31 is cut out by the predetermined configuration 32, and the container sleeve 33 longitudinally sealed to the container longitudinal direction is obtained. The container top part 3 of thin container wall is formed in top end of the sleeve body 2 with the plastic of the injection molding 35. The food product is filled with the filling apparatus 37 from the opening of the container bottom of the sleeve bottom end, and the bottom is sealed. The container 1 having the main body 2 and the top part 3 is obtained.

The present invention is not limited to the described embodiments. It is possible to make the embodiments of the present invention deform variously based on the object of the present invention without limiting the scope of the present invention.

This invention can be applied to manufacture of the packaging container which liquid food is packed and filled.

LIST OF REFERENCE NUMERALS

1. Packaging container
2. Main body of the container
3. Top part
3*a*. Shoulder part
3*b*. Neck part
4*a*, 4*b*, 4*c*. Hook
5. Lid

5*a*. 1st lid part
5*b*. 2nd lid part
6. Gripper
7. 1st hinge
8. 2nd hinge
9. Weakening line
10. Spout
11. Straw

The invention claimed is:

1. An opening device of a liquid food container comprising:

a bottom and a main body formed with a packaging material which is laminated on both sides of a paper substrate with thermoplastic resin; and a top part which is joined to an upper end of the main body and formed with thermoplastic resin, wherein the top part has a lid integrally moulded with the thermoplastic resin and covering a spout, the lid divides the top part and includes weakening lines configured for sealing and adapted to be easily cut, and the lid comprises a first lid part on a front-face side of the container, a second lid part on a rear-face side of the container, and a gripper projected from the first lid part, wherein a first hinge is formed between the first lid part and the second lid part, the weakening lines are cut when the gripper is pulled up, and the first lid part rotates on the first hinge such that the weakening lines are cut to open narrowly, and wherein a second hinge is formed in an edge of the second lid part by the rear-face side of the container, the weakening lines are cut by further pulling the gripper, and the second lid part rotates on the second hinge such that the weakening lines are cut to open more widely.

2. The opening device of a liquid food container according to claim 1, wherein the first lid part opened narrowly has a detent stopper, and the dimensions of the portion of the opening opened narrowly correspond to the dimensions of a hole for a straw.

3. The opening device of a liquid food container according to claim 2, wherein the top part comprises a shoulder part on the upper end side of the main body, and wherein a neck part projects from the shoulder part.

4. The opening device of a liquid food container according to claim 3, wherein on both sides of the second hinge, the second lid part and the shoulder part have hooks on the rear-face side edge part of the second lid part and on the shoulder part of the top part, respectively, wherein the hooks stop a return of the second lid part widely opened.

5. The opening device of a liquid food container according to claim 4, wherein the gripper has a plate shape and is projected toward a container front from the first lid part.

6. The opening device of a liquid food container according to claim 4, wherein the gripper has a plate shape joined to a first lid part top face, and projected toward a container front.

7. A liquid food container comprising:

a bottom and a main body formed with a packaging material which is laminated on both sides of a paper substrate with thermoplastic resin;

a top part which is joined to the upper end of the main body and formed with thermoplastic resin; and an opening device, wherein the top part has a lid integrally moulded with the thermoplastic resin and covering a spout, the lid divides the top part and includes weakening lines configured for sealing and adapted to be easily cut, and the lid comprises a first lid part on a front-face side of the container, a second lid part on a rear-face side of the container, and a gripper projected from the fit lid part, wherein a first hinge is formed between the first lid part and the second lid part, the weakening lines are cut when the gripper is pulled up, and the first lid part rotates on the first hinge such that the weakening lines are cut to open narrowly, wherein a second hinge is formed in an edge of the second lid part by the rear-face side of the container, the weakening lines are cut by further pulling the gripper, and the second lid part rotates on the second hinge such that the weakening lines are cut to open more widely, and wherein the gripper has a plate shape joined to a first lid part top face, and projected toward a container front.

8. An opening device of a liquid food container comprising:

a bottom and a main body formed with a packaging material which is laminated on both sides of a paper substrate with thermoplastic resin; and a top part which is joined to the upper end of the main body and formed with thermoplastic resin, wherein the top part has a lid integrally moulded with the thermoplastic resin and covering a spout, the lid divides the top part and includes weakening lines configured for sealing and adapted to be easily cut, and the lid comprises a first lid part in a center of the top part, a second lid part surrounding the first lid part, and a gripper projected from the first lid part, wherein a first hinge is formed between the first lid part and the second lid part, wherein when the gripper is pulled up, the first lid part rotates on the first hinge and the weakening line between the first lid part and the second lid part is cut to open narrowly, and wherein a second hinge is formed in an edge of the second lid part by the side of the container rear face, wherein when the gripper is further pulled up, the second lid part rotates on the second hinge and the weakening lines between the second lid part and a periphery of the top part are cut to open more widely.

9. The opening device of a liquid food container according to claim 8, wherein the dimensions of the portion of the opening of the first lid part narrowly opened correspond substantially to the dimensions of the hole for a straw.

10. The opening device of a liquid food container according to claim 9, wherein the shoulder part of the top part has a hook which stops return of the second lid part widely opened.

11. The opening device of a liquid food container according to claim 9, wherein the gripper has a shape projected above the container from the first lid part.

12. A liquid food container comprising:

a bottom and a main body formed with a packaging material which is laminated on both sides of a paper substrate with thermoplastic resin;

a top part which is joined to the upper end of the main body and formed with thermoplastic resin; and an opening device, wherein the top part has a lid integrally moulded with the thermoplastic resin and covering a spout, the lid divides the top part and includes weakening lines configured for sealing and adapted to be easily cut, and the lid comprises a first lid part in a center of the top part, a second lid part surrounding the first lid part, and a gripper projected from the first lid part, wherein a first hinge is formed between the first lid part and the second lid part, wherein when the gripper is pulled up, the first lid part rotates on the first hinge and the weakening line between the first lid part and the second lid part is cut to open narrowly, wherein a second hinge is formed in an edge of the second lid part by the side of the container rear face, wherein when the gripper is further pulled up, the second lid part rotates on the second hinge and the weakening lines between the second lid part and a periphery of the top part are cut to open more widely, and herein the gripper has a plate shape joined to a first lid part top face, and projected above the container.

* * * * *